US005946867A

United States Patent [19]

Snider, Jr. et al.

[11] Patent Number: 5,946,867

[45] Date of Patent: Sep. 7, 1999

[54] MODULAR EARTHQUAKE SUPPORT FOR RAISED FLOOR

[75] Inventors: Randle P. Snider, Jr., Plano; Marian Kutis, Richardson, both of Tex.

[73] Assignee: Ericsson, Inc., Research Triangel Park, N.C.

[21] Appl. No.: 08/960,617

[22] Filed: Oct. 29, 1997

[51] Int. Cl.[6] ..... E04B 1/18

[52] U.S. Cl. ..... 52/167.1; 52/263; 52/126.6; 52/298; 52/299

[58] Field of Search ..... 52/167.1, 167.3, 52/263, 299, 126.5, 126.6, 653.1, 651.1, 708, 656.1, 298; 248/638, 676, 677, 519

[56] References Cited

U.S. PATENT DOCUMENTS

| | | | |
|---|---|---|---|
| 1,514,577 | 11/1924 | Burrell | 52/122 |
| 1,725,414 | 8/1929 | Parish | 52/122 |
| 3,150,748 | 9/1964 | Liskey, Jr. | 189/34 |
| 3,742,662 | 7/1973 | Ballou | 52/122 |
| 3,902,289 | 9/1975 | Dashew | 52/122 |
| 3,940,900 | 3/1976 | Russo | 52/656 |
| 4,185,422 | 1/1980 | Radek | 52/36 |
| 4,277,923 | 7/1981 | Rebentisch et al. | 52/126 |
| 4,417,426 | 11/1983 | Meng | 52/126.7 |
| 4,441,289 | 4/1984 | Ikuo et al. | 52/167 |
| 4,481,748 | 11/1984 | D'Alessio et al. | 52/638 |
| 4,630,417 | 12/1986 | Collier | 52/263 |
| 4,685,258 | 8/1987 | Av-Zuk | 52/650.3 X |
| 4,899,497 | 2/1990 | Madl, Jr. | 52/126.6 |
| 4,922,670 | 5/1990 | Naka et al. | 52/126.6 |
| 5,048,242 | 9/1991 | Cline | 52/126.6 |
| 5,402,614 | 4/1995 | Jewell | 52/299 |
| 5,459,968 | 10/1995 | Jin | 52/126.6 |
| 5,548,932 | 8/1996 | Mead | 52/126.6 |
| 5,568,909 | 10/1996 | Timko | 248/519 |
| 5,628,157 | 5/1997 | Chen | 52/263 |
| 5,791,096 | 8/1998 | Chen | 52/126.6 |

*Primary Examiner*—Carl D. Friedman
*Assistant Examiner*—Phi Dieu Tran A
*Attorney, Agent, or Firm*—Rhodes, Coats & Bennett, LLP

[57] ABSTRACT

A seismic support module for supporting communications equipment on a raised floor includes a plurality of anchoring feet secured to the structural concrete floor and a plurality of support columns having generally horizontal top plates on one end thereof extending up from the anchoring feet. Attached to the plates are a plurality of tie rails and run rails forming a horizontal frame for supporting the communications equipment and the raised floor tiles. The outermost support columns are preferably braced by a plurality of diagonal cross-braces. The anchoring feet have a base plate, preferably a plurality of vertically extending sockets, and a reinforcing plate between the sockets. Preferably, the anchoring feet are interchangeable with each other as are support columns, tie rails, and run rails. The support module of the present invention is relatively simple to install and provides a seismic rated support for a portion of a raised floor that can be mass produced and does not need to be custom designed for each location. In addition, several support modules can be chained together to form a larger support structure capable of supporting several large pieces of communications equipment.

27 Claims, 7 Drawing Sheets

MODULAR EARTHQUAKE SUPPORT FOR RAISED FLOOR

FIELD OF INVENTION

The present invention relates generally to raised floors, and more particularly to a seismic rated support module for supporting communications equipment on a raised floor.

BACKGROUND

Communications equipment, such as telecommunications switching equipment, is both expensive and necessary for proper communications after a seismic event such as an earthquake. Accordingly, it is important to protect communications equipment from damage during seismic events. In an effort to reduce or prevent such damage, it is increasingly common to require that communications equipment be mounted to strong support structures, ones that allow the equipment to remain functional after a seismic event.

One common seismic support method is to attach the communications equipment directly to a structural concrete floor. However, a large portion of communications equipment is located in buildings having raised floors, such a cellular telephone company central offices. Raised floors are false floors typically having a series of abutting tiles supported from below by a grid of pedestals and crossbars. In essence, the pedestals rest on the structural concrete floor and support the crossbars and tiles. Such raised floors are common in computer and communications environments because they provide space for convenient routing of cables. With raised floors, it is very difficult or impossible to attach the communications equipment directly to the underlying floor. Instead, the communications equipment is attached to the raised floor and only indirectly connected to the structural concrete floor via the pedestals and cross-bars.

The vast majority of raised floors are not seismic rated. When communications equipment is placed on a such a non-rated floor, the weight of the communications equipment may cause the raised floor to collapse during a seismic event, resulting in equipment failure. Therefore, it is desirable for the raised floor directly under the equipment to be strong enough to withstand seismic events. These reinforced area of the floors are referred to as being seismic rated.

Under the prior art, seismic rated supports for raised floors were custom designed for each location, frequently using non-standard materials. As a result, the seismic rated floors were expensive and required a great deal of knowledge to install correctly. In addition, a significant amount of engineering effort was required in order to certify that the resulting raised floor would be seismic rated.

Thus, there exists a need for a seismic rated support for a raised floor that is easy to manufacture and install.

SUMMARY OF THE INVENTION

The support module of the present invention provides a convenient method of reinforcing portions of raised floors to withstand seismic events. The support module includes a plurality of anchoring feet, preferably disposed in a rectangular arrangement, secured to the underlying structural concrete floor. The anchoring feet have a base plate, preferably a plurality of vertically extending sockets, and a reinforcing plate between the sockets. Extending up from the anchoring feet are a plurality of support columns having generally horizontal top plates on the upper end thereof. Attached to the top plates are a plurality of tie rails and run rails forming a horizontal frame for supporting the communications equipment and the raised floor tiles. The outermost support columns are preferably braced by a plurality of diagonal cross-braces. Preferably, the anchoring feet are interchangeable with each other, as are support columns, tie rails, and run rails. The support module is relatively simple to install and provides a seismic rated support for a portion of a raised floor that can be mass produced and does not need to be custom designed for each location. In addition, multiple support modules can be chained together to form a larger support structure capable of supporting several large pieces of communications equipment.

DETAILED DESCRIPTION OF THE INVENTION

Figure 1:
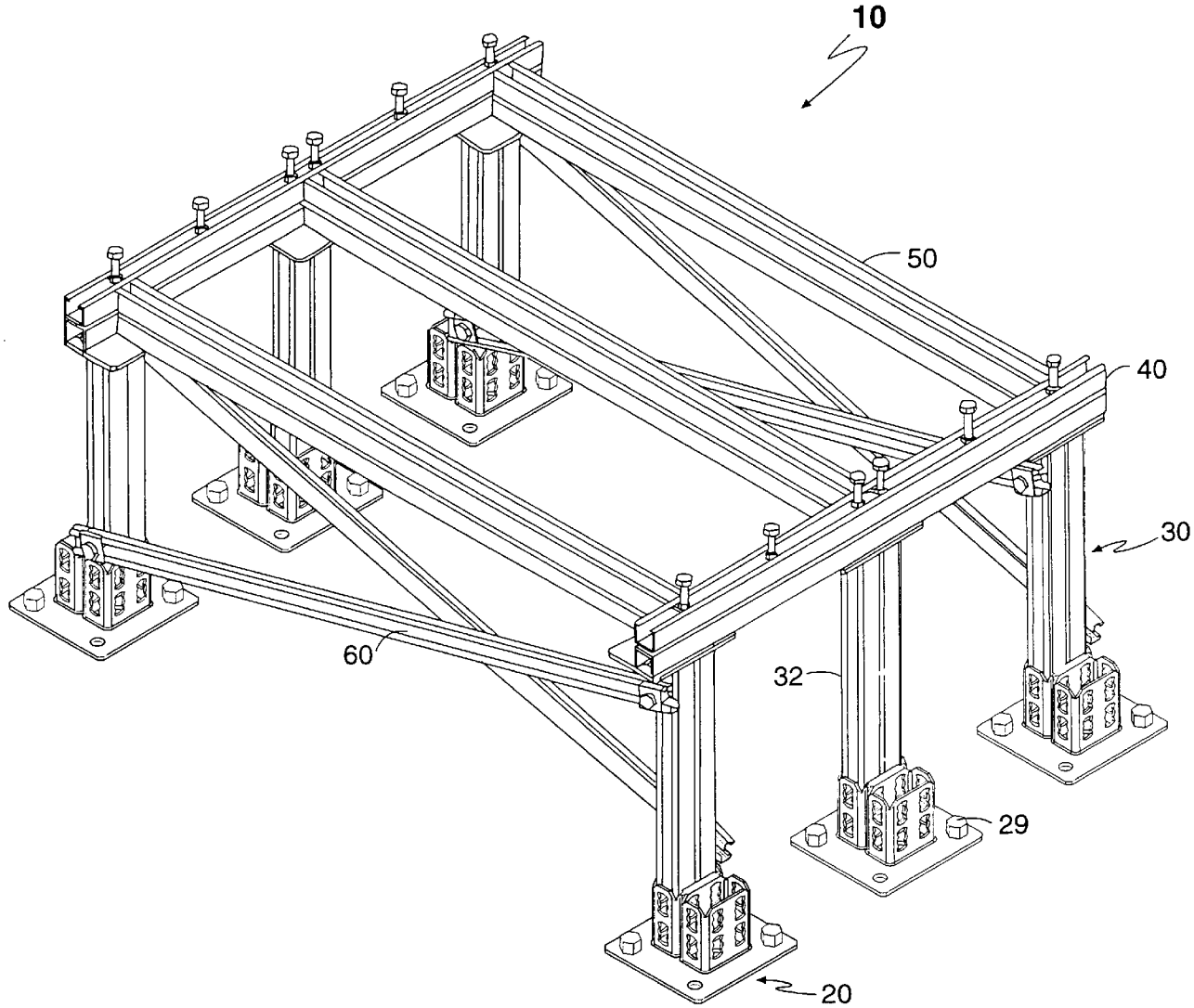
FIG. 1 is a perspective view of a support module of the present invention.

The present invention is a support module 10 for a raised floor which is designed to withstand seismic events such as earthquakes. The support module 10 includes anchoring feet 20, support columns 30, tie rails 40, run rails 50, and cross-braces 60. Multiple support modules 10 may be arranged end-to-end to form a larger support structure 200. The tiles from the raised floor are placed above, and rest on, the support module 10. Communications equipment is attached to the support module 10 through holes in the tiles.

The support module 10 is secured to the structural concrete floor by a plurality of anchoring feet 20, preferably six. The anchoring feet 20 are disposed in a spaced apart arrangement relative to each other, such as in a grid arrangement. It is preferred that the anchoring feet 20 be arranged in a rectangular formation with an anchoring foot 20 at each vertex and an additional anchoring foot 20 disposed midway along each shorter side of the rectangle. See FIG. 1.

An anchoring foot 20 includes a base plate 22 having anchor holes 23 therethrough, and an upwardly extending socket 24. See FIG. 2. Preferably, the anchoring foot 20 includes a plurality of sockets 24 extending upwardly from the base plate 22, and a reinforcing plate 28 between the sockets 24. The anchor holes 23 provide a means for securing the anchoring foot 20 to the structural concrete floor via anchoring bolts 29. The base plate 22 preferably includes four or more such anchor holes 23, each located proximate to the corners of the base plate 22. Typically no more than two of the anchor holes 23 will be used, but multiple anchor holes 23 are provided to facilitate installation in situations where one or more hole locations is unusable for some reason.

A socket 24 includes an opening adapted to receive the lower end of the support column 30. Preferably, the socket 24 is an rectilinear box open-ended at the top and having a plurality of mounting holes 26 through at least one pair of opposing sides thereof. The mounting holes 26 provide a means for releasably securing the lower portion of the support column 30 to the anchoring foot 20 via known methods such as by bolting. The mounting holes 26 are preferably slots so as to provide ready adjustment of the height of the support column 30. In a particularly preferred embodiment, there are a plurality of mounting holes 26, for example two, on opposing sides of the socket 24 and these mounting holes 26 are of a butterfly shape. The butterfly shape is preferred so as to accommodate push button fasteners 70, such as model MKN-F, made by Hilti Installation Systems of Farmers Branch, Texas ("Hilti"). The socket 24 may be formed integral to the base plate 22 or may be rigidly attached to the base plate 22 by any known method such as by welding. Preferably, the anchoring foot 20 includes two sockets 24 in a parallel arrangement.

Optionally, the anchoring foot 20 includes a reinforcing plate 28 which is attached to the base plate 22 and the socket 24. The reinforcing plate 28 may also function as a divider between two or more sockets 24. The reinforcing plate 28 may be formed integral to the base plate 22 or may be and rigidly attached to the base plate 22 and the socket 24 by any known method such as by welding.

A support column 30 includes a main bar 32 and a top plate 34. The main bar 32 may be of any type rigid material suitable for supporting a load along its main axis. Preferably, the main bar 32 includes two U-channels riveted back-to-back. In one embodiment, the main bar 32 includes pre-drilled holes 36 for accepting bolts. In another embodiment, butterfly strutnuts are disposed within the main bar 32 and prevented from readily moving along the axis of the main bar 32. Preferably, the U-channels include engaging serrations (not shown) on the underside of their lips for engaging like serrations on the butterfly strutnuts.

Figure 3:
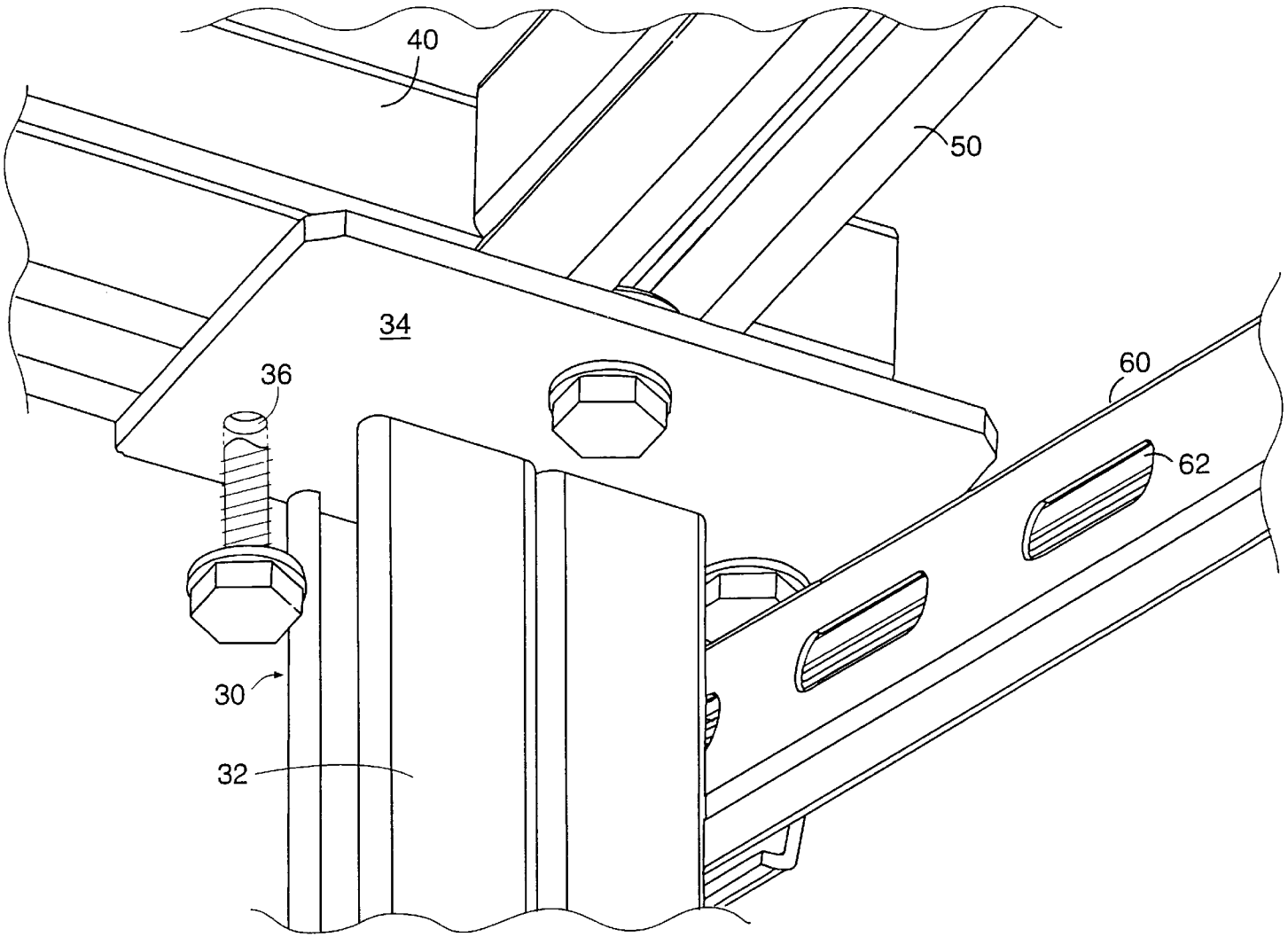
FIG. 3 is a perspective detail view of a portion of FIG. 1 near the top of a support column, looking from below.

Attached to the one end of the main bar 32 is a top plate 34 (see FIG. 3). The top plate 34 is disposed so as to be horizontal when the main bar 32 is vertical. Preferably, the top plate 34 is rectangular and disposed so that one long side is flush with one side of the main bar 32, as shown in FIG. 1 and FIG. 3. The top plate 34 preferably includes a plurality of assembly holes 36 for attachment of the tie rails 40 and the run rails 50. In one embodiment, the assembly holes 36 are arranged in triangle, as shown in FIG. 3.

The tie rails 40 and run rails 50 are elongate members that, when attached to the top plates 34, form a lattice to support the raised floor tiles. Preferably, the tie rails 40 and run rails 50 are each comprised of two U-channels riveted back-to-back.

The cross-braces 60 are elongate members that preferably include a plurality of slots 62 to facilitate adjustment. The cross-braces 60 are preferably U-channels having a height thinner than the U-channels used elsewhere in the support module 10.

To assemble the support module 10, the raised floor tiles underneath the communications equipment desired location are removed and placed aside. Then the existing raised floor support structure in that area is preferably removed so as to create a clear work space. The anchoring feet 20 are then arranged on the structural concrete floor in a spaced apart arrangement relative to each other. Preferably, the anchoring feet 20 are arranged in a rectangle having its vertices at the approximate middle of the outermost removed tiles. In one rectangular embodiment, the support module includes six anchoring feet 20; one anchoring foot 20 at each vertex and one additional anchoring foot 20 midway along each shorter side of the rectangle. In an embodiment using anchoring feet 20 having two sockets 24, the anchoring feet 20 are preferably aligned so that the sockets 24 are in a column arrangement as shown in FIG. 1. Two holes are drilled in the structural concrete floor for each anchoring foot 20 so as to line up with two of the anchor holes 23; the anchor holes 23 used should be on opposite sides of the anchoring foot 20, such as diagonally opposed. While only two anchor holes 23 per anchoring foot 20 need be employed, additional ones may also be used. Anchor bolts 29 are passed through the anchor holes 23 and into the structural concrete floor and then tightened to secure the anchoring feet 20 in place.

Figure 2:
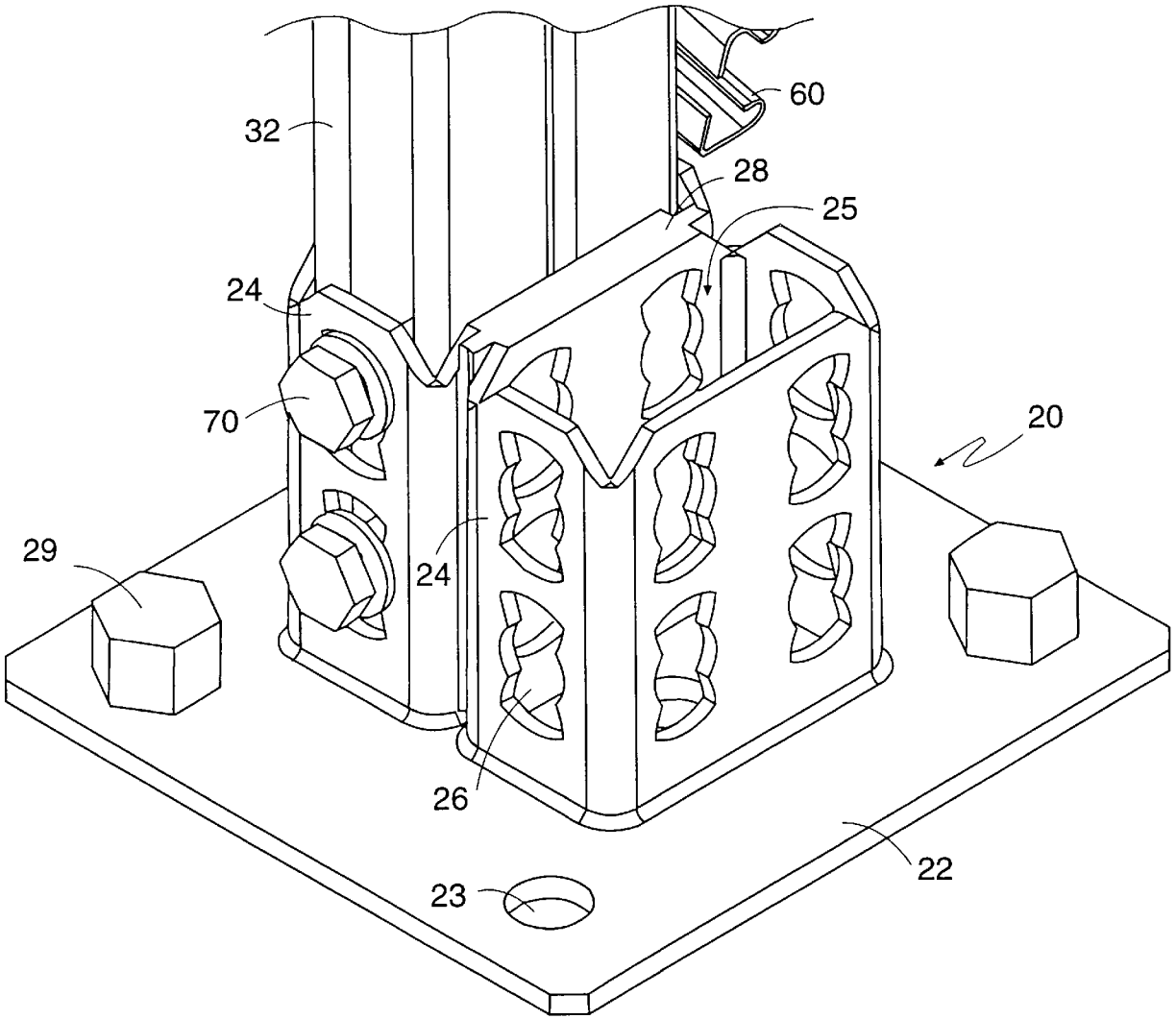
FIG. 2 is a perspective detail view of a portion of FIG. 1 near an anchoring foot.

A support column 30 is inserted into one socket 24 of each anchoring foot 20 such that the main bar 32 protrudes vertically up from the respective anchoring foot 20 and the top plate 34 forms a raised level surface. Preferably, the support columns 30 are inserted into the inner sockets 24 for each anchoring foot 20, as shown in FIG. 1 and FIG. 2. In addition, the support columns 30 should be oriented such that the top plates 34 extend inwardly and flush edge of the top plates 34 are to the outside (see FIG. 1). The support columns 30 are secured to their respective anchoring feet 20 by any means known in the art, such as by bolting. Preferably, the support columns 30 are secured to their respective anchoring feet 20 by push button fasteners 70.

A tie rail 40 is placed along the flush edges of the three top plates 34 along one side of the rectangle. The tie rail 40 is secured to its respective top plates 34 by any means known in the art, such as by bolting. A second tie rail 40 is likewise secured in a parallel orientation across the remaining three top plates 34. The tie rails 40 are preferably long enough to run the full length of the top plates 34, i.e. from the outside edge of one top plate 34 to the outside edge of the far top plate 34 on that side, as shown in FIG. 1.

A series of three run rails 50 are placed between the tie rails 40 so as to be perpendicular to the tie rails 40. Each run rail 50 is secured to a pair of top plates 34. While the run rails 50 may abut, or possibly be directly secured to, the tie rails 40, this is not necessary. The run rails 50 need only be secured to the top plates 34. The run rails 50 are secured to their respective top plates 34 by any means known in the art, such as by bolting. It is preferred that a run rail 50, such as the middle one, be located so as to directly underlie any tile edges of the raised floor tiles when the tiles are replaced.

Figure 4:
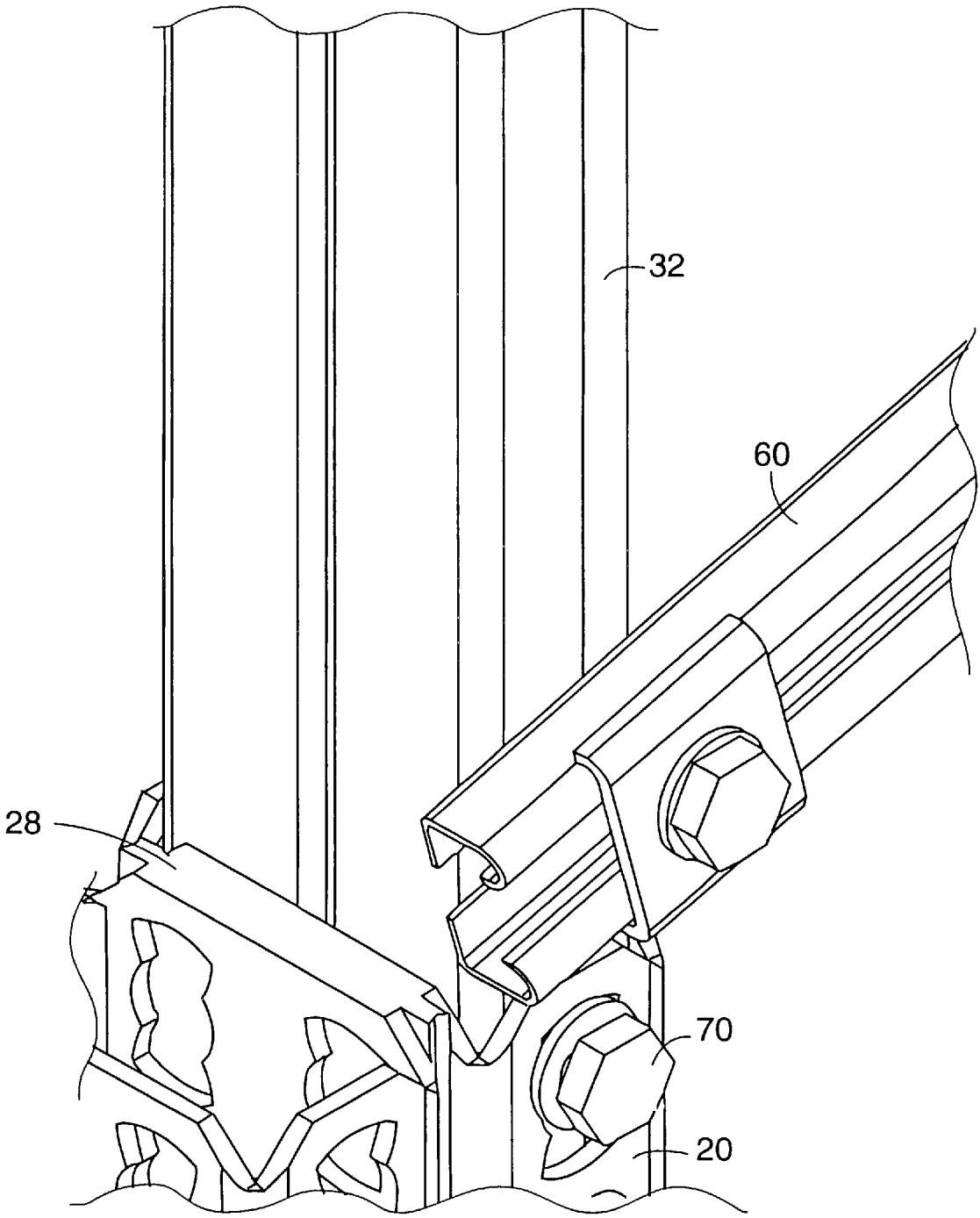
FIG. 4 is a perspective detail view of a portion of FIG. 1 near the attachment of a cross-brace to a support column.

A pair of cross-braces 60 are secured to the support columns 30 forming the long side vertices. See FIG. 1. That is, when viewed from above, the cross-braces 60 are generally parallel to the run rails 50. The cross-braces 60 are diagonally oriented, connecting the upper portion of one support column 30 to the lower portion of another. The cross-braces 60 of the pair together form an X shape, as shown in FIG. 1. The cross-braces 60 are not directly connected to the structural concrete floor; the cross-braces 60 are connected to the structural concrete floor via the support columns 30 and the anchoring feet 20. The cross-braces 60 are secured to the support columns 30 by any means known in the art, such as by bolting. See FIG. 4. Preferably, any securing bolts extend through the optionally included slots 62 in the cross braces 60. It is not typically necessary for support column 30 pairs in the middle of the support module 10, such as the fifth and sixth support columns 30 described above, to have cross-braces 60.

Before all securing means are tightened, the support module 10 must be set to the correct height. The top of the tie rails 40 and the run rails 50, which should be the same height, should be at the level of the surrounding raised floor support. In other words, when the raised floor tile is placed on top of the tie rails 40 and run rails 50, the raised floor tile should be level with the surrounding tiles. This height may be set by any means known in the art, for example by using spanning struts and threaded rods to pull the support module 10 to the correct height. Note that during this height setting, it is advantageous for the securing means connecting the support columns 30 to the anchoring feet 20 to be loose enough to allow for adjustment. In particular, the use of the push buttons 70 and mounting holes 26 in the form of butterfly slots, as described above, greatly facilitate this adjustment. Once the support module 10 is set to the correct height, the push button fasteners 70 are tightened to secure the support columns 30 in place.

During installation of the support module 10, it is necessary to temporarily remove the existing raised floor tiles. Before removing the tiles, it is advantageous to mark the locations on the tiles corresponding to the communications equipment mounting points. Holes should be drilled in these locations before returning the tiles to the raised floor. After the support module 10 has been assembled, and any securing means internal to the support module 10 have been tightened, the raised floor tiles are returned to their positions and the communications equipment is secured to the support module 10 in a manner well known in the art.

The discussion above has used a rectangular support module 10 of six anchoring feet 20, two tie rails 30, three run rails 40, and four cross-braces 60 for purposes of illustration. However, it is understood that support modules 10 having other numbers of such components are also possible and fall within the scope of the present invention. For instance, depending on spacing requirements, a support module 10 of four anchoring feet 20 , two tie rails 40, two run rails 50, and four cross-braces 60 may be suitable. Alternatively, a support module 10 of eight anchoring feet 20, two tie rails 40, four run rails 50, and four cross-braces 60 may be suitable. Other configurations of support modules 10 are also possible and fall within the scope of the present invention, including non-rectangular arrangements. It should be noted that non-rectangular arrangements may not be as cost effective due to reduced interchangeability of tie rails 40, run rails 50, or other components.

In its various embodiments, the present invention encompasses support modules 10 having anchoring feet 20 of various heights. For instance, the sockets 24 should be at least 108 mm tall, but could extend up to 172 mm or more, depending on the material and socket geometries chosen. The varying anchoring foot 20 heights may be used for varying raised floor heights. For instance, short anchoring feet 20 could be used for shallow raised floors and taller anchoring feet 20 could be used for higher raised floors.

Figure 5:
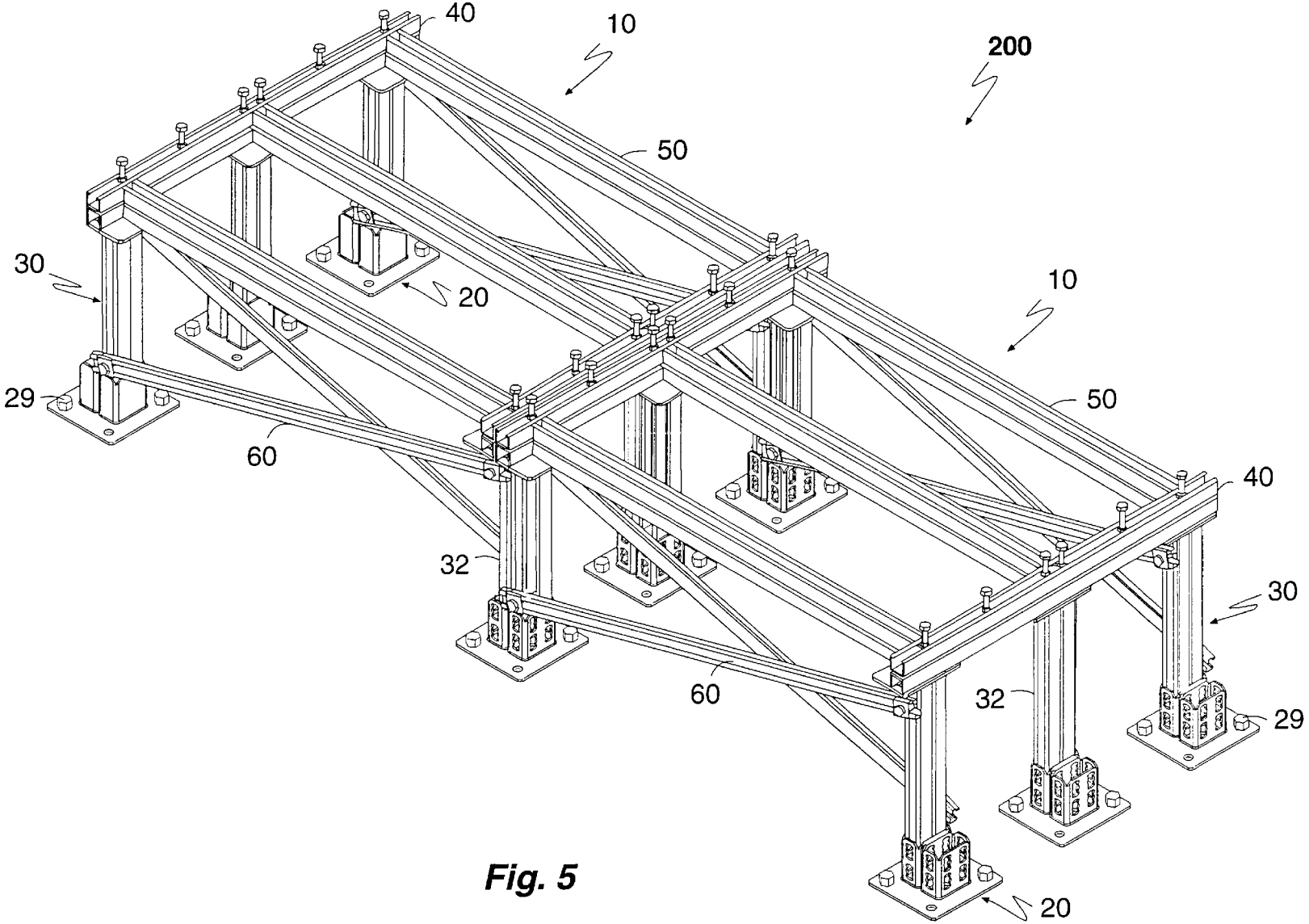
FIG. 5 is a perspective view of two support modules of the present invention joined together to form a larger support structure.

A larger support structure 200 of support modules 10 may be formed by joining together individual support modules 10. See FIG. 5. Because each anchoring foot 20 preferably includes a plurality of sockets 24, but typically only one support column 30 is directly connected to each anchoring foot 20 within a support module 10, there are typically excess sockets 24 in each support module 10. If, as is preferred, the anchoring feet 20 are oriented so that the excess sockets 24 are on the outside, it is possible to link together the support modules 10 at the anchoring feet 20 as shown in FIG. 5. Note this it is preferred that the only connection between the support modules 10 be through the common anchoring feet 20. That is, the tie rails 40 of the respective support modules 10 are not directly connected together nor are the support columns 30. In the preferred embodiment, the edges of the top plates 34 have one long side flush with one side of the main bar 32 so as to facilitate this chaining of support modules 10.

Figure 6:
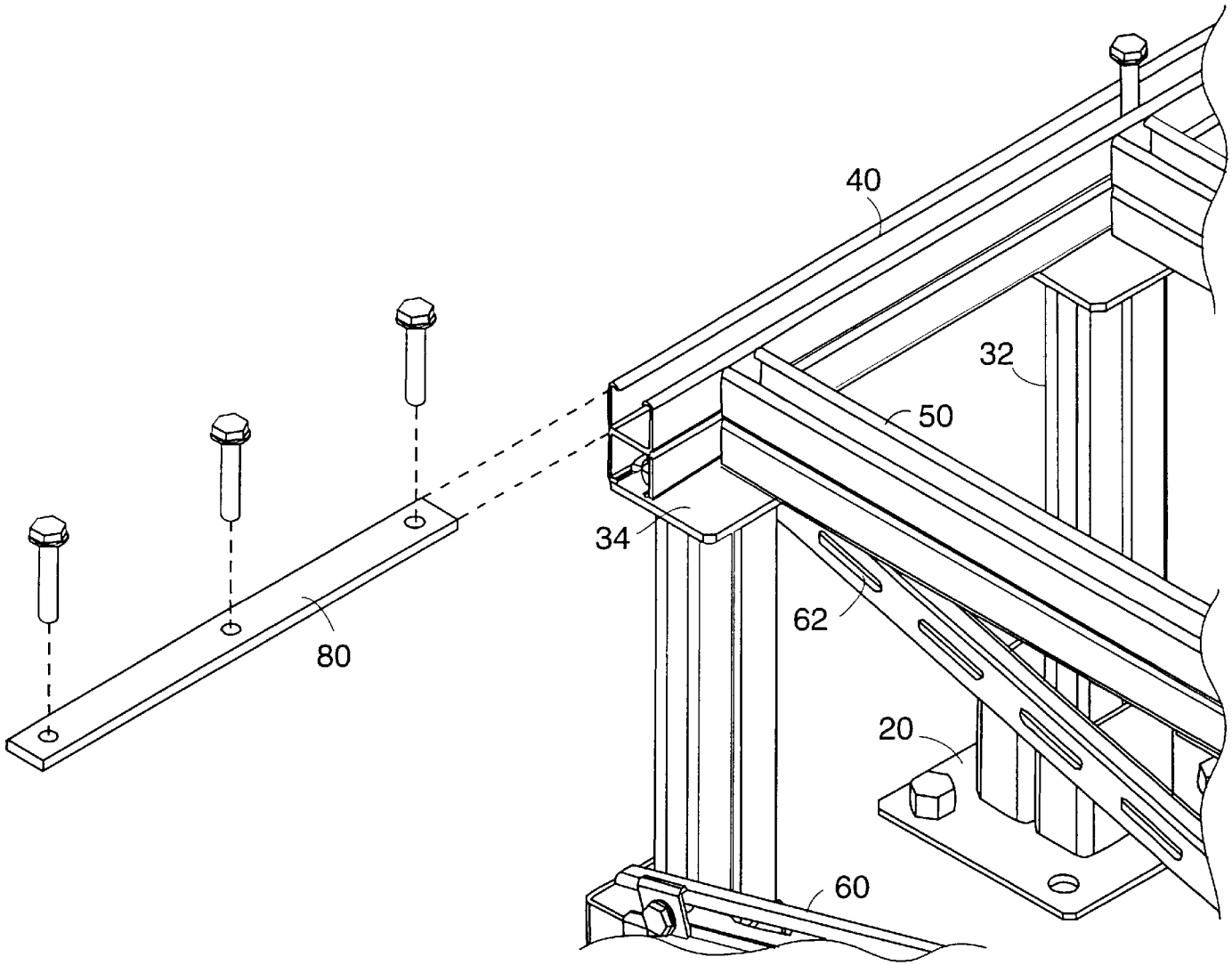
FIG. 6 is a partially exploded perspective view showing a fastening bar.

The support modules 10 may optionally include fastener bars 80 for facilitating the attachment of communications equipment to the support module 10. See FIG. 6. One reason U-channels are preferred for the tie rails 40 is that the U-channels provide a convenient space for locating fasteners that allows the fasteners to be moved, but still provides a strong connection to the fastener. Communications equipment usually has predefined mounting point spacing. A fastener bar 80 is a sturdy bar with mounting points, such as threaded holes, spaced in the same manner as the communications equipment mounting points. The fastener bar 80 may be inserted into the uppermost U-channel of the tie rail and slid to an appropriate position.

Figure 7:
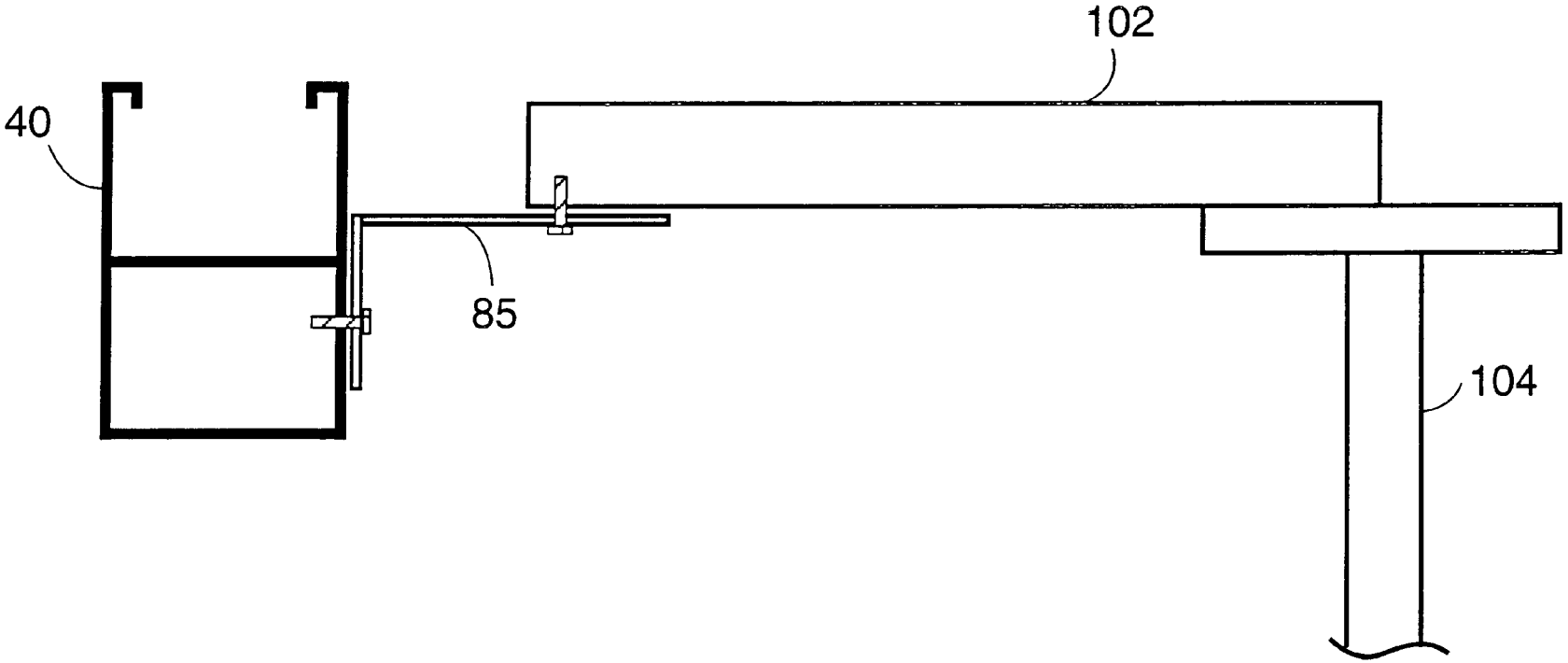
FIG. 7 shows the use of a crossbar bracket.

Traditional raised floors include crossbars 102 that help support the raised floor tiles. These traditional crossbars 102 typically span from one raised floor pedestal 104 to another. The support module 10 typically replaces a portion of the raised floor pedestal 104 network, removing part of the support for the crossbars 102. In order to provide a means for connecting these crossbars 102 to the support module 10, and spanning the gap from the support module 10 to the surrounding traditional pedestals 104, the support module 10 may also include a plurality of simple angle brackets called crossbar brackets 85. Crossbar brackets 85 are attached to the outside of the tie rails 40 and provide a means for supporting one end of a traditional raised floor crossbar 102, the other end being supported by the traditional raised floor pedestal 104. See FIG. 7.

A support module 10 of the present invention has been built using:

- six anchoring feet 20 in a 1200 mm by 756 mm rectangle; each anchoring foot 20 having a base plate 22 of 190 mm by 200 mm made from ST37-2 steel of 6 mm thickness and four mounting holes 26 of 20.6 mm diameter (one near each corner); each anchoring foot 20 including two sockets 24 of 46 mm by 92 mm made from ST37-2 steel of 4 mm thickness welded to the base plate 22 with each socket 24 having two butterfly slot mounting holes 26 on each shorter side of the socket 24; each anchoring foot 20 also including a 108 mm by 110 mm reinforcing plate 28 made from ST37-2 steel of 12 mm thickness and welded to both sockets and the base plate 22;
- six support columns 30; each support column 30 having one main bar 32 made from two steel U-channels riveted together back-to-back, the U-channels being Hilti model MS41 strut and length of 420 mm; each support column 30 including a top plate 34 of 6 mm thick ST37-2 steel welded to one end of its respective main bar 32 and having dimensions of 101 mm by 65 mm;
- two tie rails 40; each tie rail 40 made from two steel U-channels riveted together back-to-back, the U-channels being Hilti model MS41 strut and length of 922 mm;
- three run rails 50; each run rail 50 made from two steel U-channels riveted together back-to-back, the U-channels being Hilti model MS41 strut and length of 1092 mm;
- four cross-braces 60 made from steel U-channel of Hilti model MS21 strut and length of 1242 mm and having 63 mm by 13.5 mm slots spaced at 100 mm intervals along the back of the U-channel;
- twenty-four Hilti model MKN-F push buttons 70;
- twelve anchoring bolts 29, Hilti model HSLBM12/6;
- various securing hardware including ½ inch diameter bolts, grade 5 and ½ inch strutnuts, Hilti model MKN-FM½";

a fastener bar 80 made from ST37-2 steel of ⅜ inch thickness and having three ½ inch diameter threaded holes.

The support module 10 of the present invention is relatively simple to install and provides a seismic rated support that can be mass produced and does not need to be custom designed for each location. For instance, the main bars 32, tie rails 40, and run rails 50 may all be made from the same raw material stock of U-channel. In the preferred embodiment, the support columns 30 may all be made the same length and therefore become interchangeable with each other. Further, the run rails 50 are interchangeable with one another, as are the tie rails 40 and the anchoring feet 20. The components of the support module 10 may be grouped into sets and shipped to the installation location. In addition, several support modules 10 can be chained together to form a larger support structure 200 capable of supporting several large pieces of communications equipment.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A seismic support module for a raised floor above an underlying floor, comprising:

a) a plurality of anchoring feet with sockets each anchoring foot having a base plate and a vertically extending socket;

b) a plurality of support columns vertically extending from said sockets; each of said support columns having an upper portion and a lower portion and having an elongate main bar and a generally horizontal top plate;

c) a plurality of tie rails disposed parallel to one another and running generally horizontally in a first direction; each of said tie rails attached to a plurality of said support column top plates;

d) a plurality of generally horizontal run rails disposed parallel to one another and running generally perpendicular to said tie rails; each of said run rails attached to a plurality of said support column top plates;

e) wherein said tie rails and said run rails form a generally horizontal frame for supporting raised floor tiles; and f) wherein said anchoring foot includes a plurality of said sockets.

2. The seismic support module of claim 1 further comprising a plurality of cross-braces; each of said cross-braces having a first and second end and diagonally attached to at least two support columns so that said first end is proximate to said upper portion of one of said support columns and said second end is proximate to said lower portion of the another of said support columns.

3. The seismic support module of claim 1 wherein said seismic support module is of more than 30 cm in height.

4. The seismic support module of claim 1 wherein said support columns are interchangeable.

5. A seismic support module for a raised floor above an underlying floor, comprising:

a) a plurality of anchoring feet with sockets each anchoring foot having a base plate and a vertically extending socket;

b) a plurality of support columns vertically extending from said sockets; each of said support columns having an upper portion and a lower portion and having an elongate main bar and a generally horizontal top plate;

c) a plurality of tie rails disposed parallel to one another and running generally horizontally in a first direction; each of said tie rails attached to a plurality of said support column top plates;

d) a plurality of generally horizontal run rails disposed parallel to one another and running generally perpendicular to said tie rails; each of said run rails attached to a plurality of said support column top plates;

e) wherein said tie rails and said run rails form a generally horizontal frame for supporting raised floor tiles; and f) wherein said anchoring foot includes a plurality of said sockets and a reinforcing plate.

6. A seismic support module for a raised floor above an underlying floor, comprising:

a) a plurality of anchoring feet with sockets, each anchoring foot having a base plate and a vertically extending socket;

b) a plurality of support columns vertically extending from said sockets; each of said support columns having an upper portion and a lower portion and having an elongate main bar and a generally horizontal top plate;

c) a plurality of tie rails disposed parallel to one another and running generally horizontally in a first direction; each of said tie rails attached to a plurality of said support column top plates;

d) a plurality of generally horizontal run rails disposed parallel to one another and running generally perpendicular to said tie rails; each of said run rails attached to a plurality of said support column top plates;

e) wherein said tie rails and said run rails form a generally horizontal frame for supporting raised floor tiles; and f) wherein said socket includes a plurality of mounting holes and further including a plurality of push-button fasteners extending through said socket mounting holes and connecting said support columns to said anchoring feet.

7. A seismic support module for a raised floor above an underlying floor, comprising:

a) a plurality of anchoring feet with sockets, each anchoring foot having a base plate and a vertically extending socket;

b) a plurality of support columns vertically extending from said sockets; each of said support columns having an upper portion and a lower portion and having an elongate main bar and a generally horizontal too plate;

c) a plurality of tie rails disposed parallel to one another and running generally horizontally in a first direction; each of said tie rails attached to a plurality of said support column top plates;

d) a plurality of generally horizontal run rails disposed parallel to one another and running generally perpendicular to said tie rails; each of said run rails attached to a Plurality of said support column top plates;

e) wherein said tie rails and said run rails form a generally horizontal frame for supporting raised floor tiles; and f) wherein said support column main bars have an open channel construction.

8. A seismic support module for a raised floor above an underlying floor, comprising:

a) a plurality of anchoring feet secured to the underlying floor, each anchoring foot having a base plate and a plurality of vertically extending sockets;

b) a plurality of support columns vertically extending from said sockets; each of said support columns having an upper portion and a lower portion and having an elongate main bar and a generally horizontal top plate having a plurality of assembly holes;

c) a plurality of tie rails disposed parallel to one another and running generally horizontally in a first direction; each of said tie rails attached to a plurality of said support column too plates;

d) a plurality of generally horizontal run rails disposed parallel to one another and running generally perpendicular to said tie rails; each of said run rails attached to a plurality of said support column top plates;

e) a plurality of cross-braces: each of said cross-braces having a first and second end and diagonally attached to at least two support columns so that said first end is proximate to said upper portion of one of said support columns and said second end is proximate to said lower portion of the other of said support columns;

f) wherein said support columns are interchangeable g) wherein only said anchoring feet are directly secured to the underlying floor;

h) wherein said tie rails and said run rails form a generally horizontal frame for supporting raised floor tiles; and i) wherein said main bars have an open channel construction.

9. A support structure for a raised floor above an underlying floor, comprising a) a plurality of seismic support modules, wherein each seismic support module includes:

i) a plurality of anchoring feet with sockets, each anchoring foot having a base plate and a vertically extending socket;

ii) a plurality of support columns vertically extending from said sockets; each of said support columns having an upper portion and a lower portion and having an elongate main bar and a generally horizontal top plate;

iii) a plurality of tie rails disposed parallel to one another and running generally horizontally in a first direction; each of said tie rails attached to a plurality of said support column top plates;

iv) a plurality of generally horizontal run rails disposed parallel to one another and running generally perpendicular to said tie rails; each of said run rails attached to a plurality of said support column top plates;

v) wherein said tie rails and said run rails form a generally horizontal frame for supporting raised floor tiles;

b) wherein at least one of said anchoring feet receives support columns from two adjacent seismic support modules, and c) wherein said anchoring foot includes a plurality of said sockets and a reinforcing plate.

10. A support structure for a raised floor above an underlying floor, comprising a) a plurality of seismic support modules, wherein each seismic support module includes:

i) a plurality of anchoring feet with sockets, each anchoring foot having a base plate and a vertically extending socket;

ii) a plurality of support columns vertically extending from said sockets; each of said support columns having an upper portion and a lower portion and having an elongate main bar and a generally horizontal top plate;

iii) a plurality of tie rails disposed parallel to one another and running generally horizontally in a first direction; each of said tie rails attached to a Plurality of said support column top plates;

iv) a plurality of generally horizontal run rails disposed parallel to one another and running generally perpendicular to said tie rails; each of said run rails attached to a plurality of said support column top plates;

v) wherein said tie rails and said run rails form a generally horizontal frame for supporting raised floor tiles;

b) wherein at least one of said anchoring feet receives support columns from two adjacent seismic support modules, and c) wherein said socket includes a plurality of mounting holes and further including a plurality of push-button fasteners extending through said socket mounting holes and connecting said support columns to said anchoring feet.

11. A support structure for a raised floor above an underlying floor, comprising a) a plurality of seismic support modules, wherein each seismic support module includes:

i) a plurality of anchoring feet with sockets, each anchoring foot having a base plate and a vertically extending socket;

ii) a plurality of support columns vertically extending from said sockets; each of said support columns having an upper portion and a lower portion and having an elongate main bar and a generally horizontal top plate;

iii) a plurality of tie rails disposed parallel to one another and running generally horizontally in a first direction; each of said tie rails attached to a plurality of said support column top plates;

iv) a plurality of generally horizontal run rails disposed parallel to one another and running generally perpendicular to said tie rails; each of said run rails attached to a plurality of said support column top plates;

v) wherein said tie rails and said run rails form a generally horizontal frame for supporting raised floor tiles;

b) wherein at least one of said anchoring feet receives support columns from two adjacent seismic support modules, and c) wherein said support column main bars have an open channel construction.

12. A support structure for a raised floor above an underlying floor, comprising:

a) a plurality of seismic support modules, wherein each seismic support module includes:

i) a plurality of anchoring feet disposed in a rectangular arrangement and secured to the underlying floor, each anchoring foot having (1) a base plate having anchoring holes;

(2) a plurality of vertically extending sockets; said sockets having a plurality of mounting holes; and (3) a reinforcing plate between said sockets;

ii) a plurality of support columns vertically extending from said sockets; each of said support columns having an upper portion and a lower portion and having (1) an elongate main bar having an open channel construction; and (2) a generally horizontal top plate having a plurality of assembly holes; said top plate having an edge flush with one side of said main bar;

iii) a plurality of tie rails disposed parallel to one another and running generally horizontally in a first direction; each of said tie rails attached to a plurality of said support column top plates and having an open channel construction;

iv) a plurality of generally horizontal run rails disposed parallel to one another and running generally perpendicular to said tie rails; each of said run rails attached to a plurality of said support column top plates and having an open channel construction;

v) a plurality of cross-braces; each of said cross-braces having a first and second end and diagonally attached to two support columns so that said first end is proximate to said upper portion of one of said support columns and said second end is proximate to said lower portion of the other of said support columns;

vi) a plurality of push-button fasteners extending through said socket mounting holes and connecting said support columns to said anchoring feet; and b) wherein said support columns are interchangeable;

c) wherein said anchoring feet are interchangeable; said tie rails are interchangeable; and said run rails are interchangeable;

d) wherein said tie rails and said run rails form a generally horizontal frame for supporting raised floor tiles;

e) wherein only said anchoring feet are directly secured to the underlying floor; and f) wherein at least one of said anchoring feet receives support columns from two adjacent seismic support modules.

13. The support structure of claim 12 wherein said seismic support modules are not connected to each other except through one or more of said anchoring feet.

14. A seismic support module for a raised floor above an underlying floor, comprising:

a) a plurality of anchoring feet secured to the underlying floor, each anchoring foot having a base plate and a plurality of vertically extending sockets;

b) a plurality of support columns vertically extending from said sockets; each of said support columns having an upper portion and a lower portion and having an elongate main bar and a generally horizontal top plate having a plurality of assembly holes;

c) a plurality of tie rails disposed parallel to one another and running generally horizontally in a first direction; each of said tie rails attached to a plurality of said support column top plates;

d) a plurality of generally horizontal run rails disposed parallel to one another and running generally perpendicular to said tie rails; each of said run rails attached to a plurality of said support column top plates;

e) a plurality of cross-braces; each of said cross-braces having a first and second end and diagonally attached to at least two support columns so that said first end is proximate to said upper portion of one of said support columns and said second end is proximate to said lower portion of the other of said support columns;

f) wherein said support columns are interchangeable;

g) wherein only said anchoring feet are directly secured to the underlying floor; and h) wherein said tie rails and said run rails form a generally horizontal frame for supporting raised floor tiles.

15. A support structure comprising a plurality of seismic support modules according to claim 14 wherein at least one of said anchoring feet receives support columns from two adjacent seismic support modules.

16. The seismic support module of claim 14 wherein said anchoring foot further includes a reinforcing plate.

17. The seismic support module of claim 14 wherein said anchoring feet are disposed in a rectangular arrangement.

18. A support structure for a raised floor above an underlying floor, comprising a) a plurality of seismic support modules, wherein each seismic support module includes:

vi) a plurality of anchoring feet with sockets, each anchoring foot having a base plate and a vertically extending socket;

vii) a plurality of support columns vertically extending from said sockets; each of said support columns having an upper portion and a lower portion and having an elongate main bar and a generally horizontal top plate;

viii) a plurality of tie rails disposed parallel to one another and running generally horizontally in a first direction; each of said tie rails attached to a Plurality of said support column top plates;

ix) a plurality of generally horizontal run rails disposed parallel to one another and running generally perpendicular to said tie rails; each of said run rails attached to a plurality of said support column top plates;

x) wherein said tie rails and said run rails form a generally horizontal frame for supporting raised floor tiles;

b) wherein at least one of said anchoring feet receives support columns from two adjacent seismic support modules, and c) wherein said seismic support modules are not connected to each other except through one or more of said anchoring feet.

19. A support structure for a raised floor above an underlying floor, comprising:

a) a plurality of seismic support modules, wherein each seismic support module includes:

i) a plurality of anchoring feet with sockets, each anchoring foot having a base plate and a vertically extending socket;

ii) a plurality of support columns vertically extending from said sockets; each of said support columns having an upper portion and a lower portion and having an elongate main bar and a generally horizontal top plate;

iii) a plurality of tie rails disposed parallel to one another and running generally horizontally in a first direction; each of said tie rails attached to a plurality of said support column top plates;

iv) a plurality of generally horizontal run rails disposed parallel to one another and running generally perpendicular to said tie rails; each of said run rails attached to a plurality of said support column top plates;

v) wherein said tie rails and said run rails form a generally horizontal frame for supporting raised floor tiles; and b) wherein at least one of said anchoring feet receives support columns from two adjacent seismic support modules.

20. The support structure of claim 13 wherein said seismic support modules further include a plurality of cross-braces; each of said cross-braces having a first and second end and diagonally attached to at least two support columns so that said first end is proximate to said upper portion of one of said support columns and said second end is proximate to said lower portion of the another of said support columns.

21. The support structure of claim 19 wherein only said anchoring feet are directly secured to the underlying floor.

22. The support structure of claim 19 wherein said anchoring foot includes a plurality of said sockets.

23. The support structure of claim 19 wherein said support columns are interchangeable.

24. The support structure of claim 19 wherein said run rails have an open channel construction.

25. The support structure of claim 19 wherein said tie rails have an open channel construction.

26. The support structure of claim 19 wherein said anchoring feet are disposed in a rectangular arrangement.

27. A seismic support module for a raised floor above an underlying floor, comprising:

a) a plurality of anchoring feet disposed in a rectangular arrangement and secured to the underlying floor, each anchoring foot having i) a base plate having anchoring holes;

ii) a plurality of vertically extending sockets; said sockets having a plurality of mounting holes; and iii) a reinforcing plate between said sockets;

b) a plurality of support columns vertically extending from said sockets; each of said support columns having an upper portion and a lower portion and having i) an elongate main bar having an open channel construction; and ii) a generally horizontal top plate having a plurality of assembly holes; said top plate having an edge flush with one side of said main bar;

c) a plurality of tie rails disposed parallel to one another and running generally horizontally in a first direction; each of said tie rails attached to a plurality of said support column top plates and having an open channel construction;

d) a plurality of generally horizontal run rails disposed parallel to one another and running generally perpendicular to said tie rails; each of said run rails attached to a plurality of said support column top plates and having an open channel construction;

e) a plurality of cross-braces; each of said cross-braces having a first and second end and diagonally attached to two support columns so that said first end is proximate to said upper portion of one of said support columns and said second end is proximate to said lower portion of the other of said support columns;

f) a plurality of push-button fasteners extending through said socket mounting holes and connecting said support columns to said anchoring feet;

g) wherein said support columns are interchangeable;

h) wherein said anchoring feet are interchangeable; said tie rails are interchangeable; and said run rails are interchangeable;

i) wherein only said anchoring feet are directly secured to the underlying floor; and j) wherein said tie rails and said run rails form a generally horizontal frame for supporting raised floor tiles.

* * * * *